United States Patent [19]

Miko

[11] 4,013,518

[45] Mar. 22, 1977

[54] WATER JET CLEANER FOR STANDPIPES

[76] Inventor: Stephen John Miko, 6 Manitoba Street, Stouffville, Ontario, Canada, L0H 1L0

[22] Filed: Jan. 27, 1975

[21] Appl. No.: 544,632

[52] U.S. Cl. ..... 202/241; 196/122; 239/227

[51] Int. Cl.[2] ..... C10B 43/08

[58] Field of Search ..... 202/241, 254, 255, 262, 202/263; 239/227; 134/167 R, 167 C, 168 R, 168 C, 172; 196/122

[56] References Cited

UNITED STATES PATENTS

| | | | |
|---|---|---|---|
| 1,796,878 | 3/1931 | Watson | 202/241 |
| 3,196,088 | 7/1965 | Coleman | 202/241 |
| 3,400,052 | 9/1968 | Olsen | 202/241 |
| 3,480,514 | 11/1969 | Kinzler | 202/241 |
| 3,556,948 | 1/1971 | Kinzler | 202/241 |
| 3,836,434 | 9/1974 | Nuvy | 202/241 |
| 3,841,977 | 10/1974 | Stanke | 202/241 |
| 3,856,570 | 12/1974 | McDermott | 134/167 R |
| 3,892,250 | 7/1975 | Miko | 202/241 |

FOREIGN PATENTS OR APPLICATIONS

| | | | |
|---|---|---|---|
| 125,002 | 1959 | U.S.S.R. | 202/241 |

*Primary Examiner*—Hiram H. Bernstein

[57] ABSTRACT

Water jet apparatus comprising essentially a movable support platform swingable into alignment with such standpipe, water pipe means mounted on such platform, and slideable thereon into and out of said standpipe, power operated means for moving said water pipe, water jet means mounted at the end of said water pipe for directing one or more high pressure water jets substantially normal to the axis of said water pipe for breaking up deposits within said standpipe, coupling means in said water pipe whereby a front portion, carrying said jets may be rotated relative to a rear portion, power operated means coupled with said front portion of said water pipe for rotating the same, water supply means coupled to said water pipe, a high pressure pump for pumping water to said water supply means, water tank means for supplying said pump, recycle duct means extending between said water supply means and said tank for recycling water from said pipe back to said tank, when water is not required for said water jets, and valve means for controlling said recycle conduit, and said water supply means and said tank.

4 Claims, 6 Drawing Figures

WATER JET CLEANER FOR STANDPIPES

The present invention relates to water jet apparatus for cleaning gas off-takes of a cake oven battery or similar locations.

BACKGROUND OF THE INVENTION

The design of ovens such as coke ovens usually incorporates a standpipe by means of which gases are taken off the ovens. These standpipes form an acute angle or elbow sometimes known as a "goose neck." The gases from the standpipe are carried over to a collector main, where all of such gases are then collected and passed to recovery equipment, scrubbers and the like for further processing before they are vented to atmosphere.

The gases in the individual standpipes are at extremely high temperatures in the region of 2,000° F or more. Such gases are heavily ladened with entrained solids, and carbon, tar and the like. Such entrained solids and tar fractions adhere to the sides of the standpipe and rapidly accumulate and build up thereby blocking passage of gases through the standpipe. As a result, the efficiency of the ovens is greatly reduced, and substantial volumes of untreated gases will leak to atmosphere causing pollution problems and health hazards. Such gas losses also reduce the efficiency of the recovery operations.

It is therefore necessary that the standpipes be cleaned out frequently to avoid accumulations of such solids. In the past, it has been the practise to employ various forms of mechanical cleaning equipment including for example jack hammers or hydraulic scrapers. Typical examples of such equipment are shown in U.S. Pat. No. 3,196,088 Coleman and U.S. Pat. No. 3,400,052 Olsen. However, such mechanical cleaners had severe disadvantages. In the first place, they had to be operated from remote control, due to the great heat of the exiting gases. Unless such equipment was operated with great precision, the cleaning was performed in an inefficient manner. In addition, the solids become encrusted and impacted and are extremely hard. As a result considerable force must be used to remove them. However, if too much force is applied by such mechanical cleaners then the standpipes become damaged.

Accordingly, such equipment is regarded as unsatisfactory and it is clearly desirable to provide some improved apparatus for cleaning such standpipes.

BRIEF SUMMARY OF THE INVENTION

The invention seeks to overcome the foregoing disadvantages, by the provision of a water jet apparatus comprising essentially a movable support platform swingable into alignment with such standpipe, water pipe means mounted on such platform, and slideable thereon into and out of said standpipe, power operated means for moving said water pipe, water jet means mounted at the end of said water pipe for directing one or more high pressure water jets substantially normal to the axis of said water pipe for breaking up deposits within said standpipe, coupling means in said water pipe whereby a front portion, carrying said jets may be rotated relative to a rear portion, power operated means coupled with said front portion of said water pipe for rotating the same, water supply means coupled to said water pipe, a high pressure pump for pumping water to said water supply means, water tank means for supplying said pump, recycle duct means extending between said water supply means and said tank for recycling water from said pipe back to said tank, when water is not required for said water jets, and valve means for controlling said recycle conduit, and said water supply means and said tank.

More particularly, the invention seeks to provide apparatus having the foregoing advantages including support bracket means on said platform for contacting a portion of said standpipe to ensure alignment of said platform with said standpipe prior to operation of said water pipe.

More particularly, the invention provides apparatus having the foregoing advantages including guide means on said platform for guiding said water pipe while the same is advanced into said standpipe, and bearing means on said guide means for supporting said front portion of said water pipe while the same is rotated.

The various features of novelty which characterise the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF A SPECIFIC EMBODIMENT

Figure 1:
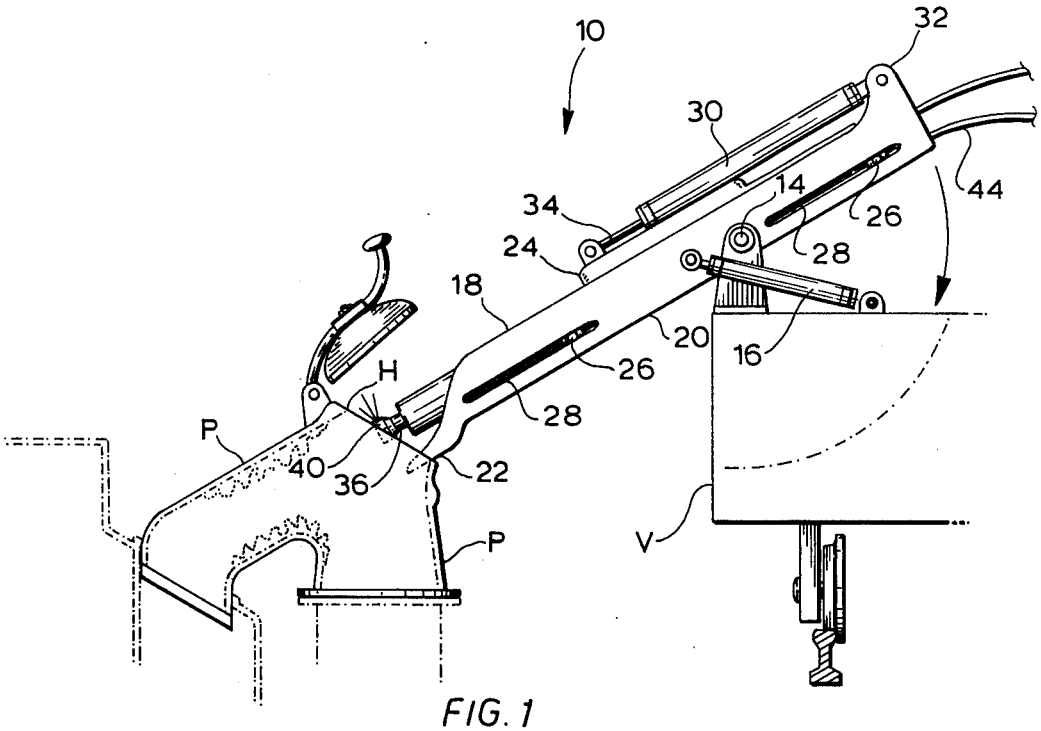
FIG. 1 is a side elevational view of the apparatus according to the invention.
Figure 2:
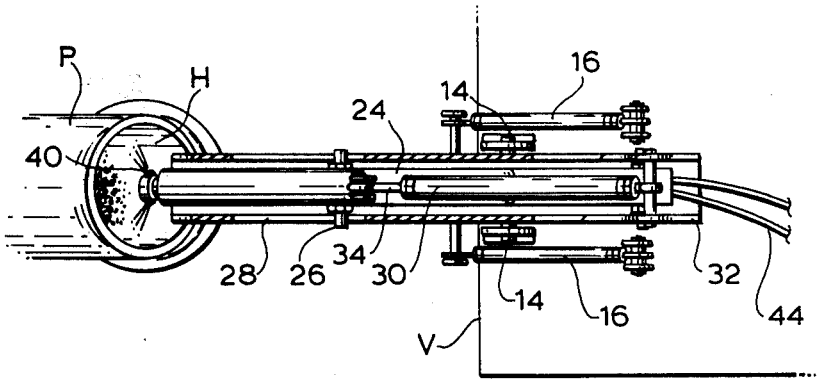
FIG. 2 is a top plan view of the apparatus of FIG. 1.
Figure 3:
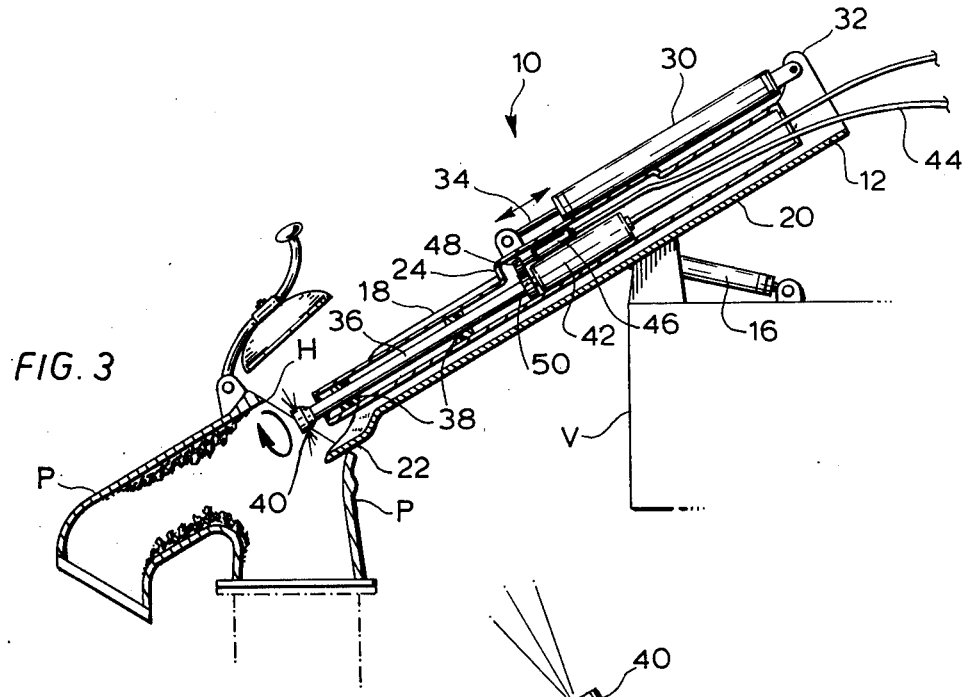
FIG. 3 is a section along the line 3—3 of FIG. 2.
Figure 4:
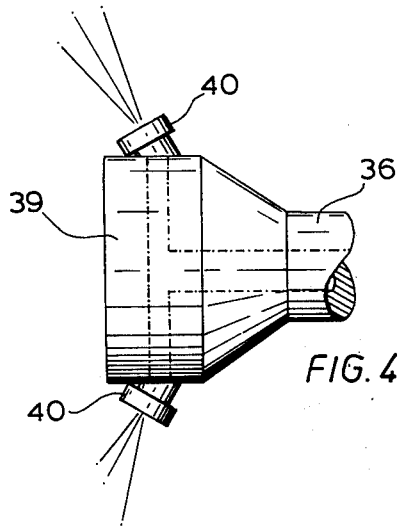
FIG. 4 is a enlarged detail of the jet nozzles.
Figure 5:
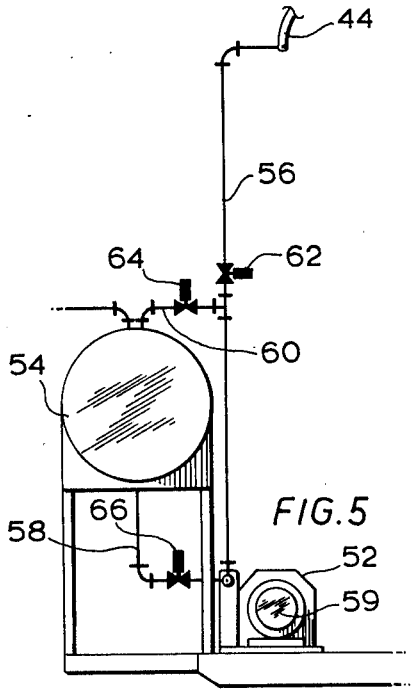
FIG. 5 is a schematic end elevation showing the water supply and controls, and, FIG. 6 is a top plan view of FIG. 5.
Figure 6:
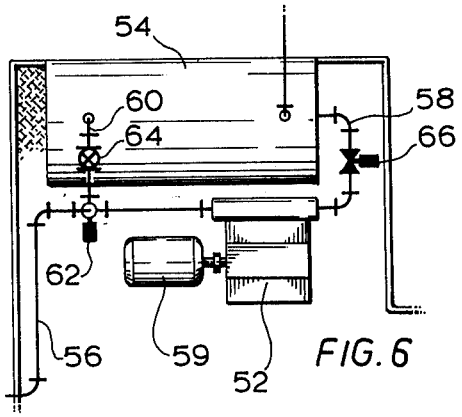

Referring now to FIGS. 1 and 2 this preferred embodiment of the invention is shown by the general reference arrow 10. It will be understood that such apparatus is normally mounted on some form of movable trolley or support so that it may be moved from one standpipe to another, bearing in mind that a coke oven battery may have many ovens arranged side by side, and for each oven a standpipe will require cleaning from time to time. Normally, the cleaning is carried out at the same time as the ovens are recharged. Such recharging is normally carried out from a vehicle mounted on rails known as a "larry car." The operator of the larry car drives the vehicle to and fro above the coke ovens recharging them from time to time in known manner. Such a vehicle is therefore not illustrated, a corner of such vehicle being shown by the general reference arrow V for the sake of simplicity.

The apparatus 10 will be seen to comprise a movable platform or support 12 swingably mounted on the larry car V by means of the pivot 14, and swingable to and fro in relation thereto by means of the hydraulic cylinder 16. In this way, the platform 12 may be swung down into alignment with the standpipe P, or may be swung upwardly out of the way alongside the larry car V. The platform 12 consists essentially of a generally open topped channel shaped structure in section having two sides 18—18, and a bottom 20. A tongue member 22 extends forwardly from the bottom 20 of platform 12, for contacting and resting on the edge of the standpipe P.

The standpipe P has an elbow bend as shown, and a port hole H through which access may be had to the standpipe for cleaning.

Within the platform 12, there is provided a slideable carrier frame 24. The carrier frame 24 is mounted on slideable mounting pins or trunnions 26—26 extending from either side of the carrier frame 24, and running in open bearing slots 28—28 formed in the side walls 18 of the platform 12.

In order to slide the carrier frame 24 to and fro, a hydraulic cylinder 30 is mounted on an upstanding arm 32 extending upwardly from the rear end of the support platform 12. The piston rod 34 of the cylinder 30 is connected to the top of the slideable carrier frame 24. Hydraulic power is supplied to the cylinder 30 by conventional supply means (not shown) which may be operated by any suitable valve mechanism from remote control, preferably located on the larry car V and accessable to the operator. Such controls are omitted for the sake of clarity.

Obviously, the hydraulic cylinder 30 could equally well be an electrical motor operating some suitable drive mechanism such as a rack and pinion or the like, or a screw drive mechanism, or could be an air cylinder, or any other suitable means for causing sliding movement of the carrier frame 24 relative to the support platform 12.

Mounted within the carrier frame 24 is a rotatable high pressure water pipe 36, rotatably mounted in bearings 38—38, and having at its forward or free end a T-head 39 having two water jet nozzles 40 arranged to direct high pressure jets of water in opposite directions at a substantial angle to the axis of the pipe 36, on opposite sides of the pipe 36. The nozzles are preferably angled slightly forwardly, according to the purposes of the invention so as to provide angled water jets directed towards the inner surfaces of the standpipe P, which will also effectively clean the sealing surfaces around the port hole H in an oblique manner.

At the remote end of the pipe 36, there is provided a high pressure rotatable coupling 42 at least a portion of which is fastened to the carrier frame 24, and a portion of the remainder is free to rotate with the pipe 36, and communicates high pressure water thereto while the same is rotating. Water is supplied to the coupling 42 by any suitable means such as the high pressure hose 44.

Also mounted on the carrier frame 24 is a drive motor 46. This motor may be electrical, hydraulic or air operated for example, and is coupled by any suitable drive means such as the gear wheels 48 and 50 to the rotatable pipe 36. In this particular case the gear wheel 50 is keyed to the pipe 36 so that rotation of the gear 48 rotates gear 50 and in turn rotates the pipe 36 and thus rotates the jets 40. However, any other suitable form of means for rotating the pipe 36 will suffice. For example, it would be possible to cause the pipe 36 to reciprocate through 180° to and fro rather than rotate 360° In this case, it would be possible to couple a flexible hose such as the hose 44 for example directly to the pipe 36 without the use of the rotatable coupling 42. However, such reciprocal movement might produce unacceptable degrees of wear on such a hose 44, and the use of the rotatable coupling 42 is therefore to be preferred.

The motor 46 is controlled by any suitable control means (not shown) preferably located in the larry car V and accessable to the operator.

In order to supply high pressure water to the hose 44 there is provided a pump 52, which is in turn supplied by means of a tank 54. The tank 54 may be refilled from time to time from any suitable water supply when the larry car is stationary, and such further water supply means is omitted for the sake of clarity.

Connection will be made to the flexible hose 44 by means of the supply pipe 56, and water is supplied from the tank to the pump by means of the pipe 58.

In order to achieve the objectives of the invention, to break up the tarry deposits by means of high pressure water jets, very high pumping capacities and pressures are required. Accordingly, the pump 52 will be of extremely high capacity, being driven by any suitable power operated motor means 59. In order to avoid damage to such a very high pressure pump, and damage to the overall system, a by-pass pipe 60 extends between the supply pipe in the tank, so that the pump may remain running, and any surplus water will simply be recycled through the tank and back to the pump. Any suitable valve control means such as the valve 62 will be provided for controlling delivery of water through the supply pipe, and further valve 64 is provided in the by-pass pipe to control flow of water through the by-pass. Instead of a by-pass system a high pressure water accumulator can be used to store the water under high pressure, thus the water can be released as required.

Preferably, the operation of these two valves is linked together so that as the valve 62 is shut off the valve 64 is opened up and vice versa.

A further valve 66 may be provided in the pipe 58 to control supply of water from the tank to the pump.

Suitable drain cocks and drain valves will normally be provided as is well known in the art (such drain means being omitted for the sake of clarity).

In operation, the drive of the larry car will align the larry car V with a particular standpipe P. Preferably, such alignment will be automatic, and will coincide with alignment of the larry car V with the top of the coke oven for recharging.

He will then by any suitable remote control means (not shown) open the port hole H, and he will then operate the hydraulic cylinder 16 so as to swing the platform 12 into its downwardly angled position as shown with the tongue 22 resting on the pipe P.

He will then operate the hydraulic cylinder 30 causing the carrier frame 24 to be extended towards the pipe P and the water jets 40 will then register with deposits within the pipe. The motor 46 is then started up to rotate the pipe 36, and at the same time the pump 52 is started up and the valves 62 and 64 are operated so as to supply water to the water jets 40. By operating the hydraulic cylinder 30, the water jets 40 can be advanced further into the pipe P or withdrawn to clean the port hole H, and when cleaning is completed, the valves 62 and 64 are shut off the pump 52 is shut down and motor 56 is switched off and the hydraulic cylinder 30 is reversed so as to withdraw the carrier frame 24. The entire platform 12 is then swung up, and the port hole is closed, and the unit is then ready for cleaning another standpipe.

If desired, arrangements can be made by any suitable means (not shown) to cause further movement of the platform 12 so that it can be aligned with the vertical portion of the standpipe P if cleaning is required there. However, in the majority of cases the deposits will build up within the elbow bend of the standpipe, and cleaning of that portion will usually clear any problems.

By the operation of the invention, it is found that hard and impacted tarry deposits can be broken up in a matter of minutes without any damage to the surfaces of the pipe P upon which they are deposited. The cleaning of such pipes by means of high pressure water jets in this way is found to produce particularly advantageous and unusual results in that the application of water at ambient air temperatures to the deposits which may be at extremely elevated temperatures produces a substantially instantaneous conversion of the water into steam As a result, substantial amounts of heat are lost by the tarry deposits very rapidly.

The rapid cooling of the tarry deposits in this manner causes them to crack up and break away from the hot surfaces of the pipe, leaving the interior of the pipe clean. The broken up portions of the deposits are sufficiently small that they are entrained with the exiting gases and carried over into the collector main for recovery processing.

The cleaning of the port hole H and its sealing surfaces, which was not possible using existing equipment, results in providing a more effective closure of the port hole H, and prevents losses of flue gases to atmosphere. Consequently fewer harmful emissions occur, and the efficiency of the recovery systems is greatly increased.

The arrangement of the jet nozzles can of course be varied provided the desired result is achieved both inside and outside the standpipe.

Thus three or more nozzles can be used provided they are spaced apart by equal arcs around the pipe to equalize the reactions from the jets in response to the very high pressures used.

By way of example, in a typical case water pressures will be in the range of 7000 pounds pre square inch, and at a flow rate of 30 gallons per minute.

The foregoing is a description of a preferred embodiment of the invention which is given here by way of example only. The invention is not to be taken as limited to any of the specific features as described, but comprehends all such variations as come within the scope of the appended claims.

What is claimed is:

1. High pressure high volume water jet apparatus for cleaning coke oven standpipes, said standpipes having an elbow and an access port and cover plate at said elbow for access to the interior of said standpipe, and sealing surfaces around said port whereby said cover plate may effectively close the same against the escape of gases therefrom, said apparatus comprising;

a support member swingable between an upper inoperative position and a lower position in alignment with a said port and having power operated means for swinging the same downwardly and upwardly;

a carrier member slideably mounted on said support member and slideably in a telescopic manner relative thereto into and out of a said port, and having power operated means for moving the same;

a high pressure water pipe rotatably mounted on said carrier member with an end extending therefrom and power operated means for at least partially rotating the same;

at least two jet nozzle means at said end of said water pipe for directing jets of water along axes at a substantial angle to the axis of said water pipe and on opposite sides thereof simultaneously whereby to establish high pressure high volume jets in a divergent manner for striking the interior of said standpipe when introduced into said port and whereby also to clean said sealing surfaces of said port in an oblique manner when located outside said port;

high pressure high volume pumping means having inlet and outlet means, tank means for supplying the inlet of said pumping means, conduit means connected to said outlet means for delivering of water to said water pipe, and recycle duct means for recycling water from said outlet to said tank, and valve means for controlling flow either through said conduit or through said recycle duct means, whereby said jets may be turned on or off without affecting the operation of said pump, and, rotatable water supply connection means having a fixed part and a rotatable part, said rotatable part being connected to said water pipe and said fixed part being fastened to said carrier member and said conduit means being connected thereto.

2. Water jet apparatus as claimed in claim 1 including high pressure water accumulator means, said pumping means accumulating water therein, and said conduit means being connected between said accumulator means and said rotatable connection means.

3. Water jet apparatus as claimed in claim 1, wherein said carrier member includes bearing means arranged along the central axis thereof for carrying said water pipe, and slider means extending outwardly from either side thereof and slideable engaging said support member, and including drive motor means on said carrier member, and drive connection means extending between said motor means and said pipe for rotating the same.

4. Water jet apparatus as claimed in claim 1 including a spray head on the end of said water pipe, and at least two said jet nozzle means mounted in said spray head offset around the axis of said water pipe by equal arcs, and angled forwardly with respect to said spray head whereby to direct at least divergent jets forwardly and outwardly with respect to said spray head.

* * * * *